US009027206B2

(12) United States Patent
Guyoton

(10) Patent No.: US 9,027,206 B2
(45) Date of Patent: May 12, 2015

(54) POLE HANDLE

(71) Applicant: Salomon S.A.S., Metz-Tessy (FR)

(72) Inventor: Alexis Guyoton, Revel (FR)

(73) Assignee: Salomon S.A.S., Metz-Tessy (FR)

( * ) Notice: Subject to any disclaimer, the term of this patent is extended or adjusted under 35 U.S.C. 154(b) by 0 days.

(21) Appl. No.: 14/132,720

(22) Filed: Dec. 18, 2013

(65) Prior Publication Data

US 2014/0165336 A1 Jun. 19, 2014

(30) Foreign Application Priority Data

Dec. 19, 2012 (FR) ..... 12 03503

(51) Int. Cl.

| | |
|---|---|
| ***B25G 1/10*** | (2006.01) |
| ***B25G 1/00*** | (2006.01) |
| ***A63C 11/22*** | (2006.01) |
| *A45B 9/02* | (2006.01) |

(52) U.S. Cl.

CPC ..... *B25G 1/00* (2013.01); *A63C 11/222* (2013.01); *A45B 2009/025* (2013.01); *A45B 9/02* (2013.01)

(58) Field of Classification Search

USPC ..... 16/114.1, 406, 421, 430

See application file for complete search history.

(56) References Cited

U.S. PATENT DOCUMENTS

| | | | | |
|---|---|---|---|---|
| 2,627,420 | A * | 2/1953 | Wheeler et al. | 280/821 |
| 3,367,673 | A * | 2/1968 | Covini | 280/821 |
| 3,825,276 | A * | 7/1974 | Adelmann | 280/821 |
| 3,982,747 | A | 9/1976 | Schweinsberg | |
| 4,288,100 | A * | 9/1981 | Aho | 280/821 |
| 5,092,629 | A | 3/1992 | Bagneres et al. | |
| 5,123,674 | A | 6/1992 | Bagneres et al. | |
| 6,311,370 | B1 | 11/2001 | Blin | |
| 6,637,773 | B1 | 10/2003 | Trinen et al. | |
| 6,988,745 | B2 | 1/2006 | Trinen et al. | |
| D527,065 | S | 8/2006 | Schary et al. | |
| 7,226,084 | B2 | 6/2007 | Lenhart | |
| 7,322,612 | B2 | 1/2008 | Trinen et al. | |

FOREIGN PATENT DOCUMENTS

| | | |
|---|---|---|
| DE | 24 17 959 A | 10/1975 |
| DE | 40 05 193 A1 | 8/1991 |
| EP | 1 474 212 B1 | 11/2004 |
| FR | 2 792 539 A1 | 10/2000 |

* cited by examiner

*Primary Examiner* — Roberta Delisle

(74) *Attorney, Agent, or Firm* — Greenblum & Bernstein, P.L.C.

(57) ABSTRACT

A pole handle comprising a wrist strap formed of a strap connected to an insert, a body oriented along a longitudinal axis, the body comprising an insert housing adapted to receive the insert, the insert housing being arranged in the upper portion of the body, such that the insert can be inserted into the housing along a direction substantially parallel to the longitudinal axis of the body, and a latching mechanism for retaining the insert in the insert housing, the unlatching of the latching mechanism being capable of being actuated directly by a displacement of the insert along the direction opposite that of insertion of the insert. The latching mechanism comprises a latch movable in relation to the body.

14 Claims, 6 Drawing Sheets

POLE HANDLE

CROSS-REFERENCE TO RELATED APPLICATION

This application is based upon French Patent Application No. 12/03503, filed Dec. 19, 2012, the disclosure of which is hereby incorporated by reference thereto in its entirety, and the priority of which is claimed under 35 U.S.C. §119.

BACKGROUND

1. Field of the Invention

The present invention relates to a pole handle provided with a wrist strap. Poles of this type are used, for example, in sports such as alpine skiing, ski touring, cross-country skiing, snowshoeing, hiking, or Nordic walking.

2. Background Information

A pole of the aforementioned type comprises a handle fitted with a wrist strap that enables the user to improve the transmission of thrust force from the hand to the pole, but also to facilitate the user's release of the handle without losing or dropping the pole. A drawback associated with the use of a wrist strap is the risk of injury due to the wrist being obstructed. Indeed, the pole may inopportunely become stuck during use. In such event, the user's hand may become caught in the wrist strap, which may cause injury to the user, such as a shoulder dislocation or an injury to the wrist.

Ski poles that have a wrist strap removably attached to the handle are known, in which the wrist strap is automatically detached under the effect of a predetermined force, in order to prevent any excessive stress. The wrist strap can detach from the handle both under the effect of a tensile force directed laterally in relation to the handle and under the effect of a tensile force directed lengthwise of the handle.

However, ill-timed releases of the wrist strap are observed in a handle of this type, as a detachment of the wrist strap under the effect of a lateral traction in relation to handle may be unnecessary, or even undesirable.

The patent document FR-A-2 792 539, and family member U.S. Pat. No. 6,311,370-B1, disclose a ski pole handle, the wrist strap of which includes an insert that is snap-fastened in the upper portion of the handle, so as to be released only under the effect of a tensile force directed lengthwise of the handle. The insert is thus positioned by deforming an element of the pole, namely a portion of the body of the handle. These deformable elements are fragile and breakable. Furthermore, the disengagement of the wrist strap requires elastic deformation of the handle body. Therefore, there is a risk of damage to this expensive solid part. Finally, the proposed solutions describe a shaped insert that is complex to manufacture, uneconomical, and can be fragile.

The patent document EP-A-1 474 212, and family member U.S. Pat. No. 7,226,084-B2, disclose a cross-country ski pole handle, the wrist strap of which comprises an insert that is snap-fastened in the upper portion of the handle. However, this wrist strap is releasable only by manual action on a latching lever. This solution does not provide disengagement under the effect of a tensile force on the wrist strap lengthwise of the handle.

SUMMARY

The present invention provides an improved pole handle, such as in light of the descriptions of the aforementioned documents.

In particular, the invention improves safety when using the pole and particularly limits the risk of injury, by allowing separation of the wrist strap only when it is biased along a specific direction.

The invention also prevents any ill-timed disengagement of the wrist strap.

Furthermore, the invention provides a handle that is simple, robust, and compact.

To this end, the invention provides a pole handle including a wrist strap comprised of a strap connected to an insert, a body oriented along a longitudinal axis, the body comprising an insert housing for receiving the insert, the insert housing being arranged in the upper portion of the body, such that the insert can be inserted into the housing along a direction substantially parallel to the longitudinal axis of the body, a latching mechanism for maintaining the insert in the insert housing, the unlatching of the latching mechanism being capable of being actuated directly by a displacement of the insert along the direction opposite that of insertion of the insert.

The latching mechanism of the handle includes a latch movable in relation to the body.

Thus, during normal use, the wrist strap is fixed and kept latched to the body of the handle. The latching mechanism makes it possible to keep the insert affixed to the strap.

With the device according to the invention, the lateral forces exerted on the wrist strap by the user do not disengage the mechanism. The wrist strap remains affixed to the body. The same is true when the user exerts a thrust force resulting in a downward force, in the direction of the tip of the pole. In this case, the thrust force is transmitted from the hand to the strap and from the wrist strap to the body. It is therefore important that the wrist strap remains attached to the body during this pushing phase.

However, if the user exerts an excessive axial tension on the strap, that is to say, an upward force that tends to move the wrist strap away from the pole, the latching mechanism then allowing disengagement of the wrist strap. An excessive axial tension is exerted, for example, when the tip of the pole remains stuck under an avalanche talus or in the roots of a tree, while the skier is moving. In the case of an avalanche, the pole can turn into an anchor and pull down the skier. It is therefore vital to free oneself from the pole.

Under normal conditions, the forces exerted on the strap are then evenly distributed over the body, via the insert. The body thus contributes to taking up the forces.

In addition, the latching mechanism is simple, compact, robust, and completely integrated into the handle. It does not have parts that are deformable and breakable due to snap-fastening, and does not subject the body to deformation. Maintenance is easy because the elements of the latching mechanism are easily replaceable.

According to advantageous but not essential aspects of the invention, such a handle may incorporate one or more of the following characteristics, taken in any technically feasible combination:

- The latch cooperates with the insert in the latching position.
- The movable latch is translated in a transverse opening provided in the body, the transverse opening being oriented along a transverse axis substantially perpendicular to the longitudinal axis of the body.
- The latch is kept in a stable latching position by an elastic mechanism; Advantageously, the latching mechanism comprises a device for adjusting the force exerted by the elastic mechanism on the latch, when the latch is in the latching position. Thus, the release force can be adjusted to improve safety and to avoid ill-timed releases.

In a latching configuration, one end of the movable latch projects from an inner surface of the housing so as to be housed in a recess arranged on an opposite wall of the insert, when the insert is positioned in the insert housing.

The latch is in the form of a pin.

The latching mechanism includes a stop for limiting the displacement of the latch towards the housing of the insert. The stop makes it possible to block the exit of the latch, and therefore to control the projecting portion of the latch head, which is important to ensure that the insert is solidly latched by the latch. This also makes it possible not to lose the latch by keeping it affixed to the body of the handle. According to one embodiment, the stop is a retaining pin cooperating with a cavity provided in the latch.

The insert housing has a tapered shape widening toward the upper opening, and the walls of the insert cooperating with the insert housing are inclined and have a complementary general shape to guide the engagement of the insert in the insert housing via positive connection. The engagement of the insert in the insert housing is thus assisted by being guided with positive connection between the flared shape of the insert housing and the inclined complementarily shaped walls of the insert. The engagement of the wrist strap is therefore fast and easy.

The insert comprises a transverse hinge shaft connecting the strap to the insert so as to enable the strap to rotate about an axis parallel to the lateral direction when the insert is mounted in the body. Advantageously, the insert includes a clearance in which the transverse hinge shaft is housed, the clearance having an upper opening, opening out in an upper surface of the insert, and a rear opening, extending along a rear transverse direction, when the insert is retained in the body, the body comprising a rear clearance in alignment with the rear opening when the insert is retained in the body, in order to allow lateral pivoting of the strap between a vertical position and a horizontal position. The wrist strap can thus pivot freely in relation to the handle body by an angle of at least 90° between the axial or vertical position and the lateral or horizontal position, making the use of the pole smooth and comfortable. For example, the strap forms a first loop surrounding the hinge shaft which extends in the width of the strap and forms a second loop consecutive to the first loop for passage of the hand of the user. Thus, when the user holds the handle and the strap surrounds the user's wrist, the downward pressure on the strap is transmitted to the body of the handle by the strap. The entire width of the strap thus participates in taking-up the thrust force. In addition, the strap is compact and fully integrated in the knob in the lateral position, thereby improving its robustness.

The upper surface of the insert has an upper edge continuous with an upper end of the handle body, when the insert is retained in the handle body. The upper end of the pole can thus maintain a generally ergonomic, planar, or convex shape facilitating the grip by the palm of the skier's hand during the ascent, for example for the practice of free-ride or ski touring.

The invention also provides a pole equipped with a handle as defined above.

BRIEF DESCRIPTION OF DRAWINGS

Other characteristics and advantages of the invention will become apparent from the following description, given by way of non-limiting example, with reference to the annexed drawings, in which.

DETAILED DESCRIPTION

Figure 1:
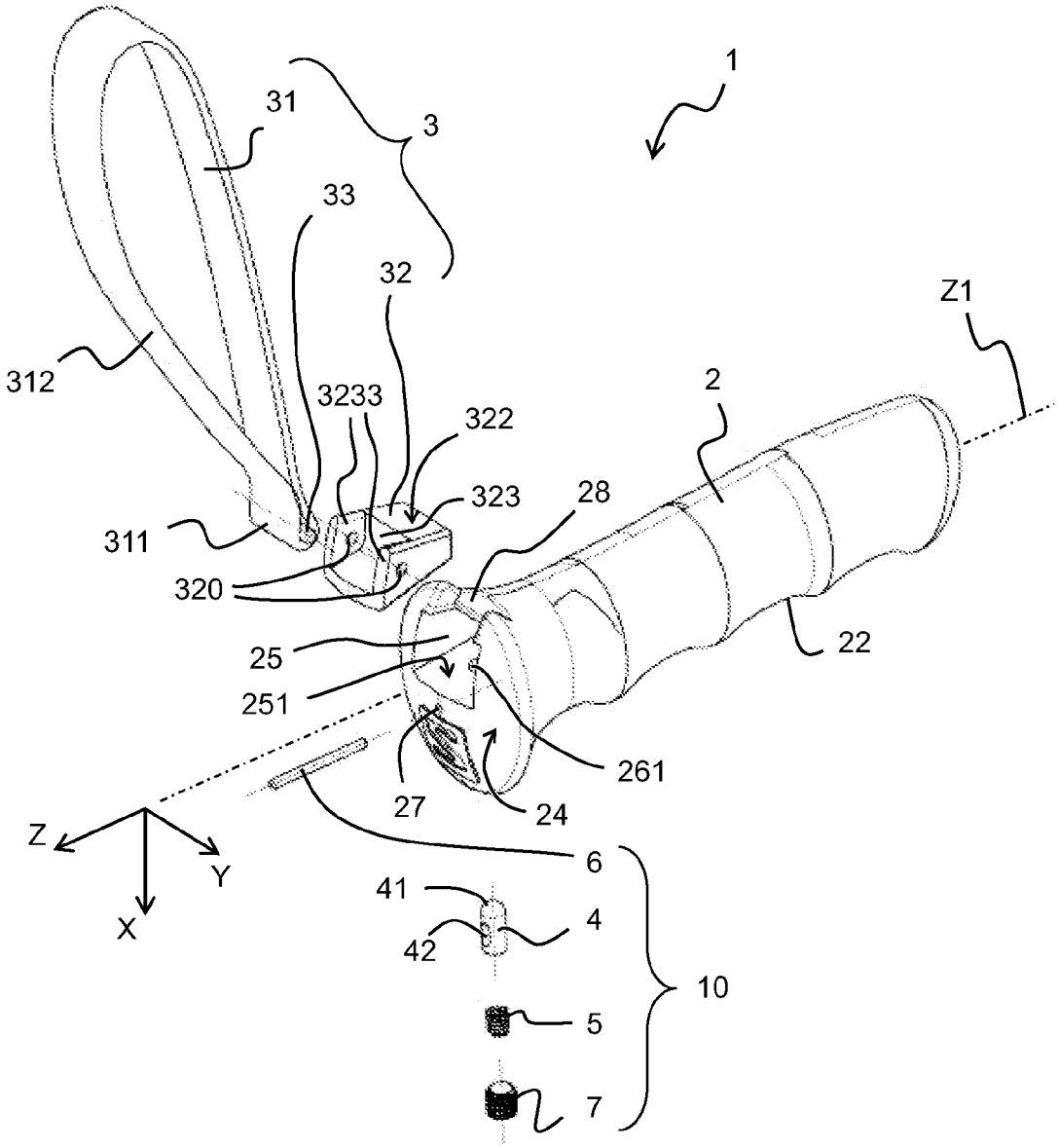
FIG. 1 is an exploded perspective view of a first embodiment of a pole handle.
Figure 2:
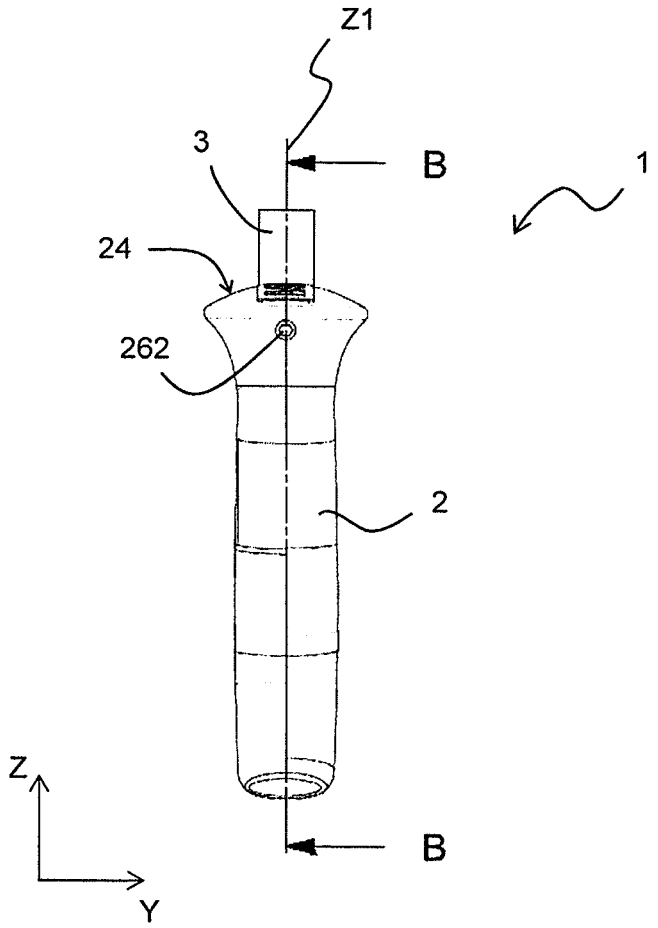
FIG. 2 is a front view of the handle of FIG. 1 in the assembled state.

In the drawing figures, identical elements are designated by the same reference numerals.

Hereinafter, an orthonormal reference system XYZ is used, for which the transverse direction X and lateral direction Y are perpendicular to one another and perpendicular to the longitudinal direction Z of the pole. The transverse direction X is oriented from the rear towards the front of the pole.

The "lower" or "bottom" side corresponds to the side of the tip of the pole, as opposed to the "upper" or "top" side corresponding to the side of the knob of the handle of the pole. The "front" or "anterior" portion designates the portion referring to the forward walking direction of the user, as opposed to the "rear" or "posterior" portion. Also referred to as "vertical" is the longitudinal direction Z, and as "horizontal" a direction perpendicular to the longitudinal direction Z. These definitions apply to all of the elements of the handle according to the invention, in its assembled configuration.

FIGS. 1-5 show a first embodiment of a pole handle 1, intended for the practice of cross-country skiing, alpine skiing, ski touring, "free ride", snowshoeing, or Nordic walking.

The handle 1 comprises a body 2 and a wrist strap 3.

Figure 3:
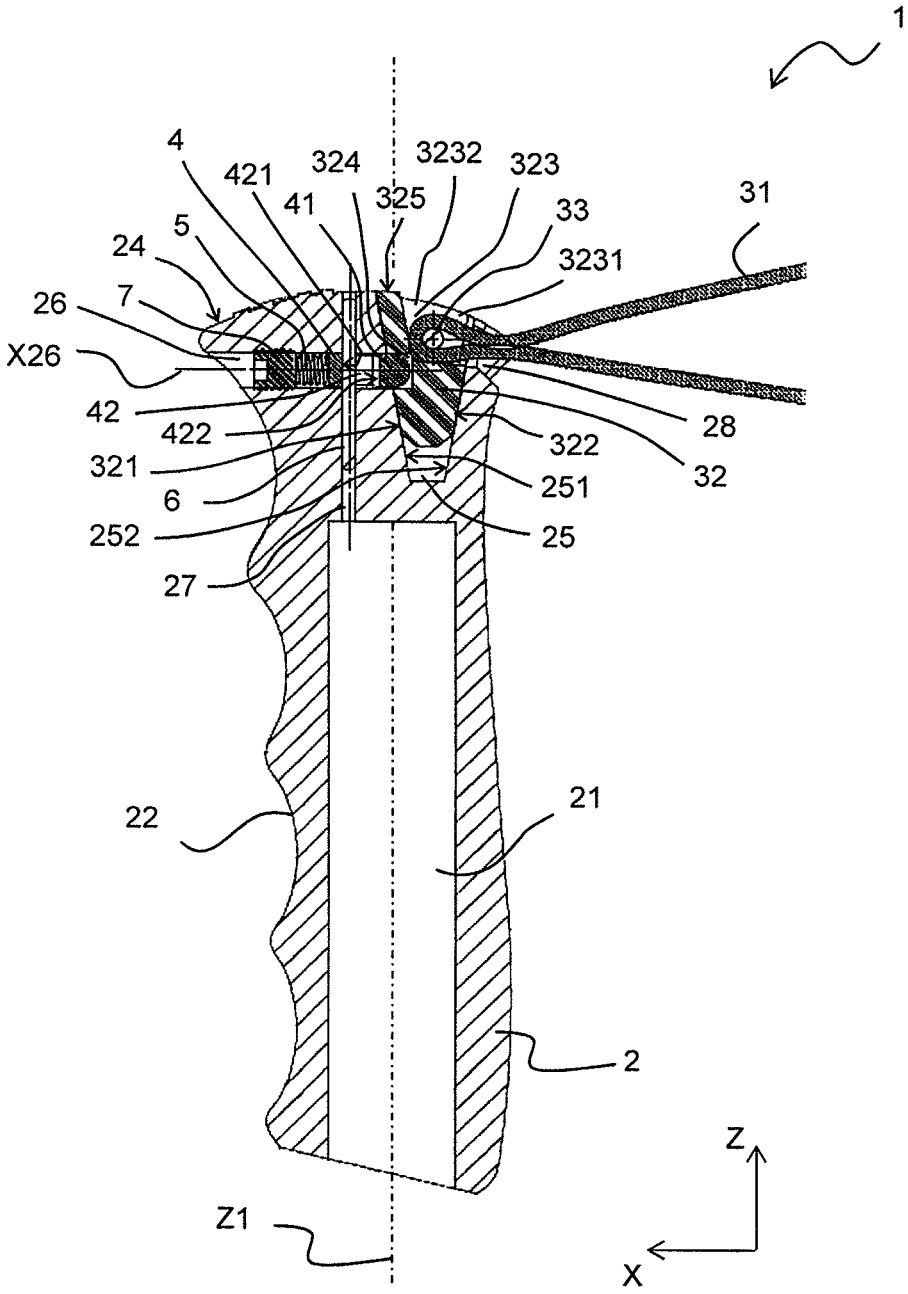
FIG. 3 is a cross-sectional view along the line B-B of the handle of FIG. 2, the handle being in the latched position and the latch being in the projecting position.

As can be seen in FIG. 3, the body 2 conventionally comprises a generally cylindrical hollow inner space 21 opening out in the lower portion of the body 2. The inner hollow space 21 is shaped to receive a longitudinal rod of the pole, this rod generally ending with a tip comprising an end-piece and possibly a washer. The axis of the cylindrical hollow space 21 defines the longitudinal direction Z1 of the handle 1.

On the outside, the body 2 comprises a gripping portion 22 adapted to be grasped by the user and capable of including a series of projections and recesses distributed longitudinally to guide the fingers and the palm of the user's hand. On the top, the upper end 24 of the body 2 may have the shape of a knob, substantially convex, adapted to support the palm of the hand of the user, especially during ascent phases.

The wrist strap 3 comprises a strap 31 and an insert 32 capable of being removably fixed in an insert housing 25 of the body 2. The insert housing 25 is arranged in the body 2 so that the opening of the insert housing 25 opens out in the upper end 24. The insert 32 can therefore be inserted in or removed from the insert housing 25 along an axial direction, that is to say, along a direction substantially parallel to the longitudinal axis Z1 of the handle 1.

The insert housing 25 has, for example, a tapered shape widening toward the upper opening. Here, the insert housing 25 is defined by a front surface 251 and a rear surface 252, limiting the housing along the X direction. The front 251 and rear 252 surfaces are not vertical but form an angle, such as greater than 15° therebetween, in a particular embodiment.

Figure 4:
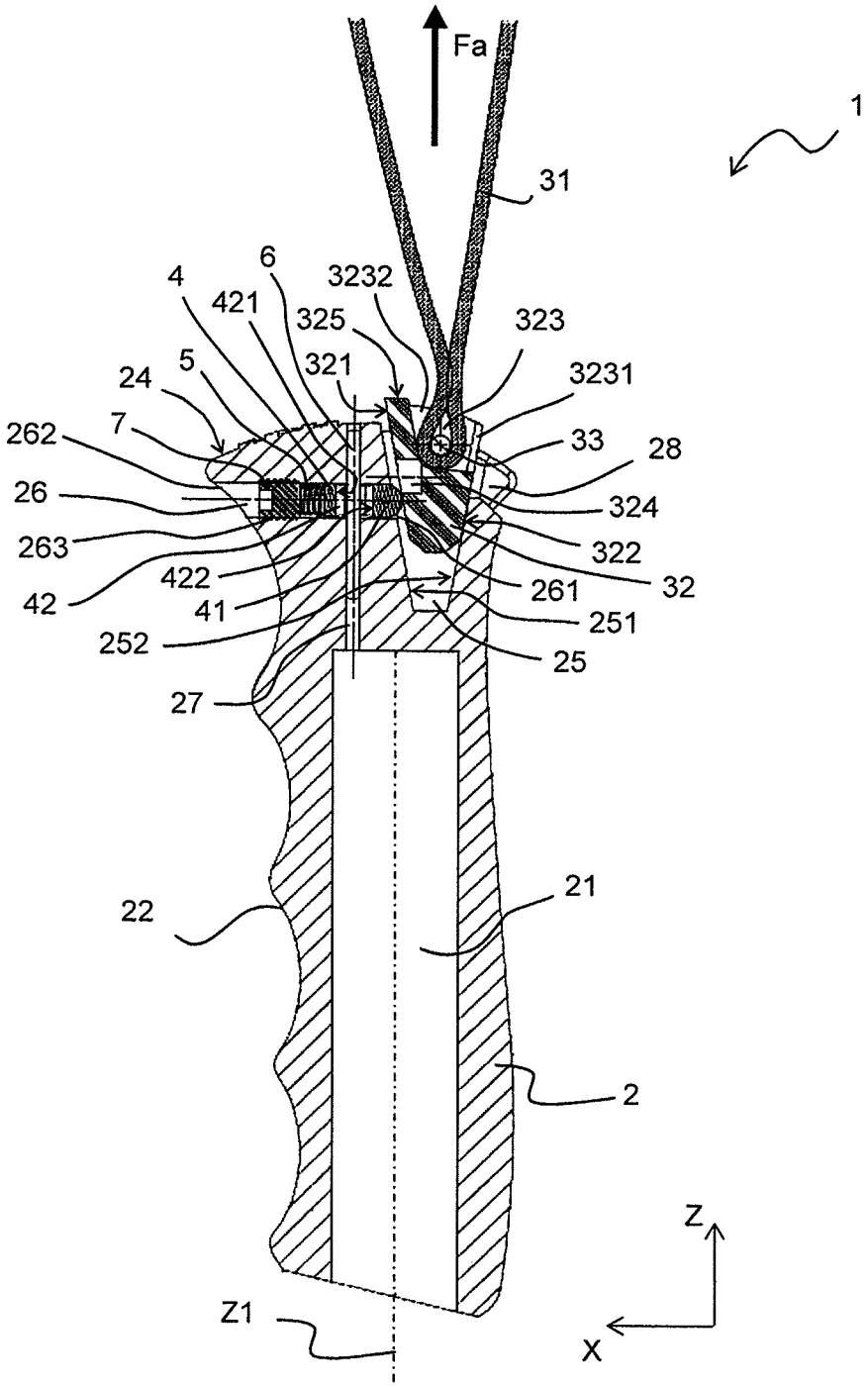
FIG. 4 is a view similar to FIG. 3, in which the handle is unlatched and the latch is in the retracted position.
Figure 5:
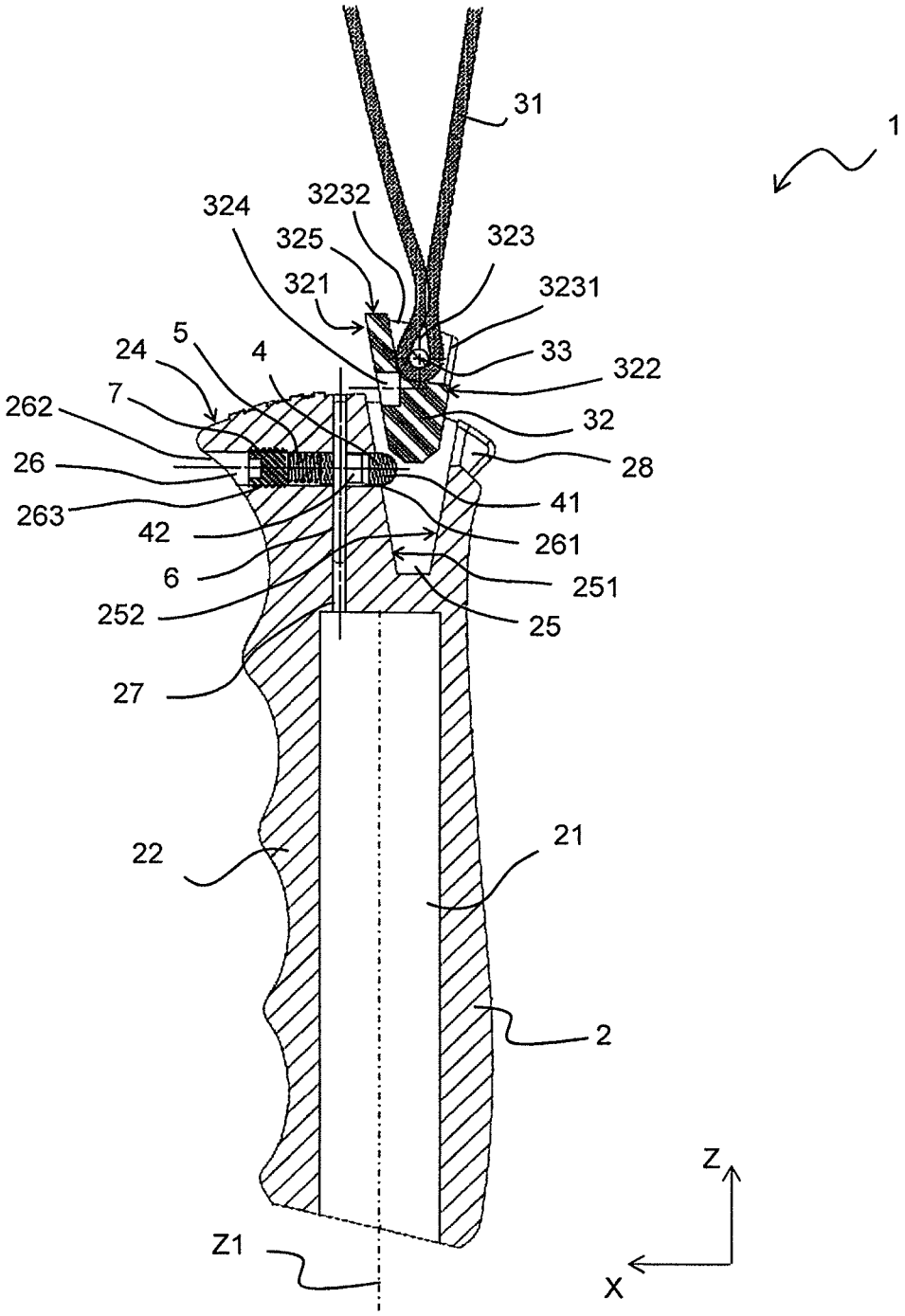
FIG. 5 is a view similar to FIG. 3, in which the handle is unlatched and the latch is in the projecting position.

The insert 32 is also defined by a front wall 321 and a rear wall 322. Here also, the front wall 321 and rear wall 322 are not "vertical" but form an angle therebetween, which is substantially the same as the angle between the front 251 and rear 252 surfaces. When the insert 32 is positioned in the insert housing 25, the front surface 251 of the housing is opposite the front wall 321 of the insert. The front surface and the front wall cooperate with one another. Similarly, the rear surface 252 of the housing is opposite the rear wall 322 of the insert. The rear surface and the rear wall cooperate with one another. FIGS. 3 to 5 illustrate this construction of the surfaces 251, 252 and of the walls 321, 322 that are inclined in a V-shape and additional structures.

Other additional embodiments having a tapered shape are within the scope of the invention, such as pyramidal, prism, or frusto-conical shapes. The engagement of the insert 32 in the insert housing 25 is thus facilitated by being guided via a positive connection between the flared shape the insert housing 25 and the complementarily shaped walls of the insert 32.

The wrist strap 3 can further comprise a hinge shaft 33 connecting the strap 31 to the insert 32.

In the example shown, the insert 32 has a clearance 323 in its upper portion, forming a rear opening 3231 and a top opening 3232. This clearance 323 is demarcated laterally by two lateral walls 3233 spaced apart by a distance slightly greater than the width of the strap 31. Each of the lateral walls is pierced by a through-hole 320. The two through-holes 320 are aligned along a direction substantially parallel to the Y direction when the insert 32 is mounted in the body 2. Each through-hole 320 is adapted to receive one end of the hinge shaft 33. The hinge shaft is mounted tightly in these through-holes.

In this case, a portion of the strap 31 narrowly surrounds the hinge shaft 33, the hinge shaft 33 extending in the direction of the width of the strap 31. The hinge shaft 33 is therefore housed in a first loop 311 of the strap 31, loosely, so that the first loop can rotate freely about the hinge shaft. The length of the hinge shaft 33 is slightly greater than the width of the strap 31, so that the ends of the hinge shaft 33 project from the loop. Furthermore, the strap 31 forms a second loop 312, consecutive to the first loop 311, for passage of the hand of the user.

This construction enables the strap 31 to rotate about the transverse hinge shaft 33, that is to say, an axis parallel to the Y direction when the insert 32 is mounted in the body 2.

Advantageously, the clearance 323 is dimensioned to enable the strap 31 to pivot about the hinge shaft 33 by an angle of at least 90°. Thus, the strap is shiftable from a horizontal configuration, in which the strap extends substantially horizontally rearward (FIG. 3), to a vertical position, in which the strap extends substantially vertically upward (FIGS. 4 and 5), or vice versa.

Once the insert 32 is assembled to the body 2, the rear opening 3231 of the clearance 323 opens out in the upper and rear portion of the upper end of the body 2. Advantageously, the body 2 comprises a rear clearance 28 communicating with the insert housing 25. The rear clearance 28 is dimensioned such that, when the insert 32 is retained in the body 2, the rear opening 3231 of the insert 32 and the rear clearance 28 are aligned, thereby creating a recess that is open towards the rear of the body for housing the strap. This enables the strap 31 to shift between the horizontal configuration (FIG. 3) and the vertical configuration (FIGS. 4 and 5). Consequently, the wrist strap 3 can pivot freely in relation to the body by an angle of at least 90° between the horizontal configuration and the vertical configuration, making the use of the pole 1 smooth and comfortable.

Moreover, because the wrist strap 3 surrounds the transverse hinge shaft 33 over its width, the orientation of the strap 31 is such that its width is always oriented along the Y direction. This specificity makes it possible for the rear clearance 28 of the body 2 to be a shallow recess, compared to the strap 31, the orientation of which is such that its width is always oriented along the X or Z direction. Therefore, the strength of the handle is reinforced.

Furthermore, when the user exerts a thrust force on the strap via his/her wrist, as may be the case during practice of cross-country skiing, the force is transmitted by the strap 31 to the body 2, in the area of the lower portion of the clearance 28 and the lower portion of the rear opening 3231 of the insert 32. This construction provides a large support surface between the strap 31 and the body 2. The strap 31 thus presses over its entire width or at least over a large portion of its width and over a length adding the support surface of the lower portion of the rear clearance 28 to the support surface of the lower portion of the rear opening 3231. Therefore, the thrust force is transmitted not only by the insert 32 but also by the strap 31 in the area of this contact zone. The insert 32 and the body 2 are therefore less biased, thereby enabling a better distribution of the thrust forces. Furthermore, the wrist strap 3, thus arranged, is compact and fully integrated into the knob of the upper end 24 of the body, in a horizontal configuration (FIG. 3).

Alternatively, the strap 31 may be differently assembled to the insert 32. For example, the hinge shaft 33 may pass through a hole extending through the width of the strap.

According to another aspect, the upper surface 325 of the blocking insert 32 is provided to have a shape that is continuous with the upper end 24 of the body 2, when the insert 32 is retained in the body 2. For example, the top 325 has a rounded and convex shape. The upper end of the handle 1 thus maintains an ergonomically convex general shape to facilitate the grip by the palm of the user's hand. Thus, during the ascent slope, in particular for the practice of free-ride or ski touring, the skier can push on the knob of the pole without feeling localized pressure on his/her hand. Indeed, the thrust force exerted by the palm is distributed over a large surface, which reduces the localized peaks of force.

The wrist strap is thus comprised of three simple, economical, and easy to make parts, namely the strap 31, the insert 32, and the hinge shaft 33. The insert 32 includes no deformable portion, which makes it sturdy.

The handle 1 further comprises a latching mechanism 10 comprising a latch 4 movable transversely between a projecting position, corresponding to the latching position, and a retracted position.

The latch 4, for example, has the shape of a pin, one end of which, namely the latch head 41, has a substantially hemispherical rounded shape. The latch 4 is positioned in a transverse housing 26 of the handle body 2, oriented along a direction parallel to the X direction. The latch head 41 points toward the rear of the body 2. The transverse housing 26, for example, has a cylindrical shape having a diameter slightly greater than the diameter of the latch, which enables the latch to slide freely in the transverse housing. In this example, the transverse housing 26 is horizontally centered, and therefore passes through the center of the body 2. The transverse housing 26 comprises a first opening 261 opening out into the insert housing 25.

In the projecting position or latching position, the latch head 41 projects from the front surface 251 of the insert housing 25, through the first opening 261.

In this first embodiment, the insert 32 includes a transverse recess 324 arranged in the front wall 321 cooperating with the front surface 251 of the insert housing 25. The transverse recess 324 is dimensioned and positioned to receive the latch head 41 when the insert 32 is positioned in the insert housing 25. The transverse recess 324 is for example cylindrical. Thus, when the insert 32 is inserted into the insert housing 25, by moving the latch 4 into the latching position, the latch 4 blocks the axial displacement of the insert 32, that is to say, along a direction parallel to the axis Z. Indeed, the latch 4 co-operates with the transverse recess 324, thereby making it possible to retain the insert 32 in the body 2. This ensures the latching of the insert.

The latching mechanism 10 also includes an elastic mechanism 5, in this case a coil spring, exerting a force on the latch to bring it into the latching position. Thus, due to the spring 5, the latching configuration is preferred.

The latching mechanism 10 further includes, in this example, a retaining pin 6 adapted to cooperate with a cavity 42 arranged in the latch 4. This cooperation enables the transverse displacement of the latch 4, that is to say, along a direction parallel to the X direction, up to a predetermined transverse position, the latching position, in one direction. Moreover, this cooperation may also limit the transverse displacement of the latch in the other direction.

The retaining pin 6 is received in a pin housing 27 of the handle body 2 opening out in the transverse housing 26 receiving the latch 4. The pin housing 27 and the retaining pin 6 have complementary shapes, such as, for example, cylindrical shapes, the retainer pin 6 being forcibly or tightly mounted, for example, in the pin housing 27. The axis of the pin housing 27 extends substantially longitudinally, that is to say, along a direction parallel to the Z direction, so as to be capable of blocking the transverse displacement of the latch 4.

In this example, the cavity 42 is sized in relation to the position of the retaining pin 6 assembled in the body 2, such that the retainer pin 6 comes into contact with a first surface 421 of the cavity 42 when the latch 4 is in the projecting or latching position (FIGS. 3 and 5), and such that the retaining pin 6 comes into contact with a second surface 422 of the cavity 42 defining a maximum retraction stroke when the latch 4 is in the retracted position. The cavity 42 extends in the transverse direction, parallel to the X direction, to block the transversal displacement of the latch 4. The transverse length of the cavity 42 defines the maximum displacement stroke between the retracted position and the projecting position. The retaining pin 6 thus forms a double stop for the displacement of the latch 4, with one stop in each direction.

The cavity 42 is an oblong through-hole, for example, in which the retaining pin 6 passes. The pin housing 27 extends longitudinally in the body 2, beyond the transverse housing 26. The retaining pin 6 then extends through the cavity 42 of the latch 4, thereby providing a better retention of the latch 4. In addition, the cavity 42 may be centered in the latch 4.

According another embodiment, not shown, the cavity is a notch having a lateral or annular opening, which avoids possible problems of alignment of the axis of the retaining pin 6 with the cavity of the latch 4 when mounting the elements of the handle 1.

The retaining pin 6 thus makes it possible to stop the exit of the latch 4 and therefore to control the projecting portion of the latch head 41 in the insert housing 25. This ensures that the latch head 41 is in the latching position, which is important to ensure effective cooperation between the latch 4 and the transverse recess 324 of the insert. Moreover, the portion of the latch projecting from the front surface 251 of the insert housing 25 contributes in determining the force required for engaging and disengaging the wrist strap.

In order for the latch to be able to retract under an axial force on the insert 32, the latch portion projecting from the front surface 251 has an inclination in relation to a horizontal plane XY, when the latch is in the latching position. Indeed, when the insert is pulled axially, the lower edge of the transverse recess 324 comes into contact with the latch head 41. Thus, due to the slope of the latch portion projecting from the front surface 251, the axial force is transposed into a transverse force, thereby enabling the latch 4 to be pushed within its transverse housing 26. This slope may be constant (pyramid, cone) or variable (hemisphere). In the example shown, the latch head 41 is hemispherical, which enables this transposition of force. Alternatively, the latch head 41 may appear differently, for example in the form of a pyramid, or a cone. What matters is that the latch head 41 has a properly oriented slope, inclined at an angle in relation to a horizontal plane.

Furthermore, limiting the displacement of the latch 4 in at least one direction, namely the direction of the latching position, further ensures that elements of the latching mechanism 10 will not be lost. Finally, this stop, formed by the cooperation between the pin 6 and the cavity 42, makes it possible to obtain a stable, precise, and defined latching position.

The force for engaging and disengaging the wrist strap is mainly determined by the elastic mechanism 5 used to bring the latch 4 in the latching position. It is therefore advantageous to be able to adjust the force exerted on the latch 4 by this elastic mechanism 5.

The latching mechanism 10 may thus comprise a device for adjusting the release threshold, that is to say, for adjusting the force exerted by the elastic mechanism on the latch, in particular when the latch is in the latching position. This adjusting device can be arranged in the transverse housing 26 receiving the latch 4.

According to this first embodiment, the transverse housing 26, which receives the latch 4, is a through-housing. It opens out in the insert housing 25 via a first opening 261, as seen above, on the one hand, and on the outside, at the front of the body 2, via a second opening 262, on the other hand. An inner portion 263 of the cylindrical transverse housing 26, located on the side of the second opening 262 opening out at the front of the handle body 2, is threaded. An adjusting screw 7 is then tightened into the threaded inner portion 263 to seal the transverse housing 26.

The spring 5 is interposed between the adjusting screw 7 and the latch 4. A first end of the spring 5 is in contact with the adjusting screw 7, and a second end of the spring 5 is in contact with the latch 4. This arrangement makes it possible to more or less urge the spring 5 against the latch 4 along the transverse position of the adjusting screw 7. To change the release threshold of the latching mechanism, that is to say, the force with which the wrist strap 3 is retained by the latch 4, it suffices to tighten or loosen the adjusting screw 7. Therefore, the adjusting screw 7 therefore constitutes the device for adjusting the release threshold.

The device for adjusting the release threshold is thus easily accessible through the second opening 262 of the transverse housing 26, at the front of the handle 1, which is convenient.

The insert housing 25 is, for example, eccentric and offset rearward of the upper end 24 of the handle body 2, in particular to enable the latching mechanism 10, incorporating an adjusting device 7 for adjusting the release threshold, to be housed at the front. To obtain this offset, the latching mechanism 10 acts, via the latch 4, only on one side of the insert 32, namely the front wall 321.

In the retracted position, the latch head 41 can at least partially enter into the transverse housing 26. The latch 4 no longer cooperates with the transverse recess 324, which makes it possible to release the insert 32 from the body 2. The latch 4 is in the unlatched position.

In this embodiment, the latching mechanism 10 includes the latch 4, the spring 5, the retaining pin 6, and the adjusting screw 7. All these elements are housed in the upper front portion of the body 2.

The disengagement of the wrist strap will now be explained.

When a predetermined axial tension force, or a pulling, is exerted on the insert 32, as shown schematically by the arrow Fa in FIG. 4, the insert 32 urges the latch 4 against its elastic return. This action causes the partial retraction of the latch head 41 in the transverse housing 26 in order to disengage the latch 4 from the transverse recess 324 of the insert 32. The hemispherical latch head 41 assists the displacement of the latch towards a retracted position.

The predetermined axial tension force Fa is an excessive bias exceeding a normal axial tensile force. One defines an axial tensile force substantially parallel to the longitudinal axis Z1 of the body 2, a force exerted axially in the longitudinal axis Z1 of the handle 1, in a cone centered on the longitudinal axis Z1 with a maximum opening of 60°. An excessive axial tension force Fa can be exerted, for example because the tip of the pole 1 remains jammed, for example under an avalanche talus or in the roots of a tree. In this case, the pole begins to pull too hard on the wrist, and therefore on the user's arm, with a substantial axial component mainly due to the speed of the user in relation to the blocking of the pole. The risk associated with this jam is injury to the user. Such risk is limited due to the disengagement of the wrist strap.

The release threshold is the maximum axial force to be exerted on the wrist strap until it separates from the body of the handle. This is the value of the minimum axial tension force to be exerted on the insert 32 in order to overcome the return force of the spring 5. By pulling axially on the insert 32, the latter acts on the latch head 41 so that the latch retracts in its transverse housing 26. This displacement of the latch 4 compresses the spring 5. Consequently, to obtain the desired displacement of the latch, that is to say, a displacement enabling the latch 4 to no longer cooperate with the transverse recess 324 of the insert 32, it is necessary to exert a predetermined force on the latch. This force is directly related to the stiffness of the spring 5, and is directly transposable into a minimum axial tension force to be exerted on the insert 32; this is the release threshold. As seen above, the stiffness of the spring, and therefore the release threshold, can be adjusted by the adjusting mechanism 7.

Then, when the wrist strap 3 is fully detached from the body 2, the latch head 41 returns to the projecting position under the effect of the elastic bias of the spring 5. The exit of the latch 4 from the transverse housing 26 is limited by the abutment of the retaining pin 6 in the first surface of the cavity 42 of the latch 4 (FIG. 5).

To reposition the wrist strap 3, it suffices to apply a reverse axial force on the insert 32. The insertion of the insert 32 in the insert housing 25 is thus fast and easy, especially due to the guiding by positive connection between the inclined walls of the insert 32 and the flared shape of the insert housing 25.

Thus, an axial force acts on the latch, either to engage or disengage the latching mechanism 4. This makes it possible to affix the wrist strap 3 to the body 2 when the insert 32 is inserted in the insert housing 25. The axial force in the direction bringing the insert 32 closer to the body 2 engages the latching mechanism 4. Conversely, an axial force in the direction spacing the insert 32 apart from the body 2 disengages the latching mechanism 4. The wrist strap 3 then separates from the body 2.

In normal use, separation of the wrist strap is not desired. Therefore the insert 32 must be provided to remain affixed to the body 2.

For this, the insert 32 and the insert housing 25 are designed so that the insert can be positioned in the housing along a substantially axial direction Z. Thus, if a force is exerted on the insert along a direction other than the axial direction Z, the insert remains in its housing. It remains affixed to the body 2.

Most of the time, during normal practice of an activity requiring the use of this type of pole, such as alpine skiing, for example, the wrist strap is oriented substantially horizontally, that is to say, perpendicular to the axis Z of the pole. The wrist strap is then in a horizontal configuration, in which a portion of the wrist strap is housed in the rear opening 3231 of the insert 32 and in the rear clearance 28 of the body 2. In certain cases, in particular during practice of cross-country skiing or hiking, the wrist strap can be oriented parallel to the axis Z of the pole, but in the direction of the tip. No force is exerted on the insert 32 to space it apart from the body 2; it is actually the opposite. In the area of the pole knob, this configuration of the wrist strap is similar to the horizontal configuration in the direction in which the first loop 311 is oriented horizontally. The difference is mainly related to the orientation of the second loop 312 of the strap 31.

This design makes it possible not to actuate the latching mechanism 10 when the wrist strap 4 is not biased axially, in the direction of relative spacing between the insert 32 and the body 2, as is the case during normal use. The wrist strap 3 therefore remains affixed to the body 2 in this configuration.

The wrist strap is therefore removable under the effect of a predetermined axial tension force exerted on the strap 31 and remains blocked in the handle body during transverse or horizontal biases.

The latching mechanism thus makes it possible to ensure the safety of the user by enabling the wrist strap 3 to detach in situations likely to cause injury to the user, while avoiding ill-timed releases in undesired situations. Furthermore, the latching mechanism is simple, compact, robust, and fully integrated into to the handle 1. It does not have parts that are deformable and breakable due to snap-fastening. According to this invention, the body 2 is subject to little deformation, which enables it to be preserved, especially as it typically is an expensive part. In addition, maintenance is easy because the elements are easily replaceable if damaged.

Figure 6A:
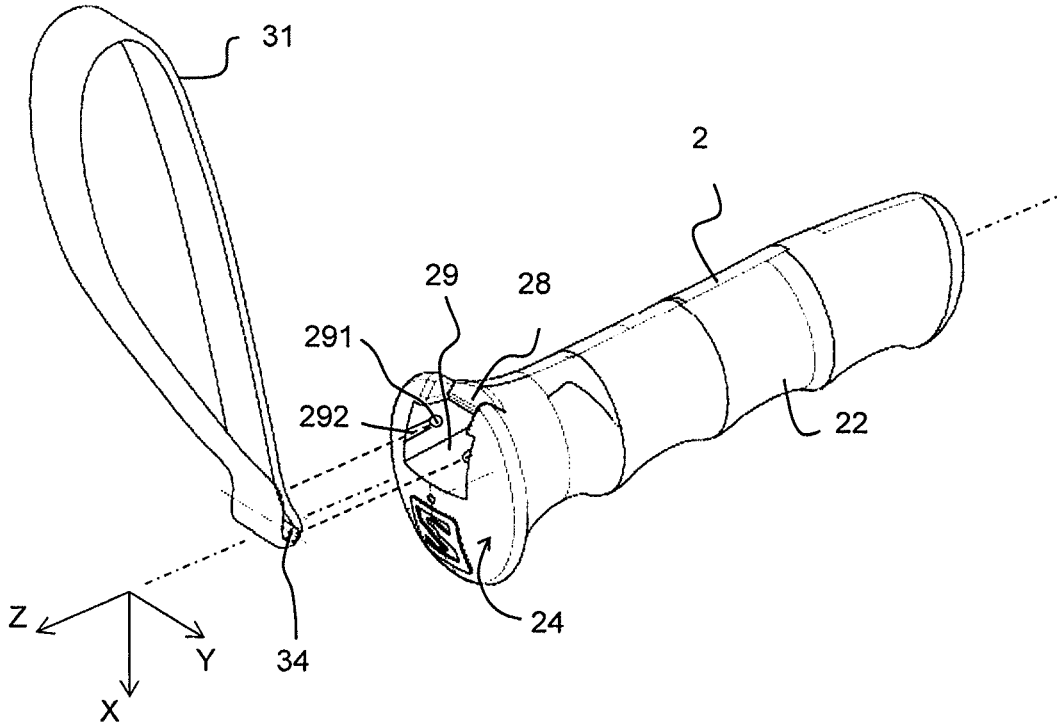
FIG. 6*a* is an exploded perspective view of a second embodiment of a pole handle.
Figure 6B:
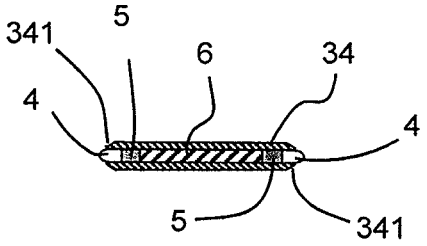
FIG. 6*b* is a cross section of a connecting shaft of the handle of FIG. 6*a*.

FIGS. 6*a* and 6*b* show another exemplary embodiment of a pole handle, in which a connecting shaft 34 replaces the insert.

In this embodiment, the latching mechanism is integrated into the connecting shaft 34. The connection shaft 34 is configured to fit into a shaft housing 29 of the body 2. The shaft housing 29 is arranged in the body 2, so that the opening of the shaft housing 29 opens out in the upper end 24.

The connecting shaft 34 can therefore be axially received in and removed from the shaft housing 29, that is to say, in a direction substantially parallel to the longitudinal axis Z1 of the pole handle 1.

The body 2 comprises a rear clearance 28 communicating with the shaft housing 29, enabling the wrist strap 3 to pivot freely in relation to the handle body by an angle of at least 90°, between a vertical position and a horizontal position.

As shown schematically in FIG. 6*b*, the connecting shaft 34 forms a tube oriented transversely, that is to say, along a direction substantially parallel to the Y direction, when the connecting shaft is assembled in the body 2. Within the tube 34, two latches 4 are slidable along the tube. Each latch 4 is arranged at one end of the tube 34 and is movable between a projecting position, in which a portion of the latch 4 projects from an end of the tube 34, and a retracted position, in which the latch enters within the tube 34.

The latches 4 are elastically returned to the projecting position by two springs 5 of the latching mechanism. The springs 5 are interposed between the latches 4 and an inner shaft 6 inserted into the tube 34.

Advantageously, the ends of the tube 34 are deformed so as to maintain the latches 4 within the tube. These deformations 341 serve as stops for the latches.

FIG. 6*a* shows that the shaft housing 29 comprises two lateral recesses 291 configured to receive the respective latch heads when the connecting shaft 34 is inserted into the shaft housing 29. Furthermore, the shaft housing 29 may comprise two longitudinal guiding grooves 292 arranged between the upper end 24 and the lateral recesses 291, for guiding the axial insertion of the connecting shaft 34 in the shaft housing 29.

When the connecting shaft 34 is inserted into the shaft housing 29, the latches 4 deploy in the projecting position, in the lateral recesses 291. They then block the axial displacement of the strap 31, thereby retaining the wrist strap 3 in the body 2.

Because the shaft housing 29 opens out in the upper end 24 of the pole, the wrist strap 3 remains blocked in the body 2 during transverse biases. However, when a predetermined axial traction greater than the return force of the latches 4 is exerted on the strap 31, the latch heads enters at least partially into the tube 34. In this retracted position, the latches 4 are disengaged from the shaft housing 29, so that the strap 31 is no longer retained in the body 2. The wrist strap 3 is then detached from the body 2.

At least because the invention is disclosed herein in a manner that enables one to make and use it, by virtue of the disclosure of particular exemplary embodiments of the invention, the invention can be practiced in the absence of any additional element or additional structure that is not specifically disclosed herein.

The invention claimed is:

1. A pole handle comprising:

a wrist strap comprising:

a strap; and an insert;

the strap being connected to the insert;

a body oriented along a longitudinal axis, the body comprising an insert housing structured and arranged to receive the insert, the insert housing being structured and arranged in an upper portion of the body, such that the insert can be inserted into the insert housing along a direction substantially parallel to the longitudinal axis of the body;

a latching mechanism structured and arranged to retain the insert in the insert housing in a latching position, unlatching of the latching mechanism being capable of being actuated directly by a displacement of the insert along a direction opposite an insertion direction of the insert;

the latching mechanism comprising:

a latch movable in relation to the body; and a stop structured and arranged to limit an amount of movement of the latch in a direction toward the insert housing.

2. A pole handle according to claim 1, wherein:

the latch cooperates with the insert in the latching position.

3. A pole handle according to claim 1, wherein:

the latch translates in a transverse hole arranged in the body, the transverse hole being oriented along a transverse axis substantially perpendicular to the longitudinal axis of the body.

4. A pole handle according to claim 1, further comprising:

an elastic mechanism structured and arranged to maintain the latch in a stable latching position.

5. A pole handle according to claim 4, wherein:

the latching mechanism comprises an adjusting device for adjusting a force exerted by the elastic mechanism on the latch when the latch is in the latching position.

6. A pole handle according to claim 1, wherein:

in a latching configuration, one end of the latch projects from an inner surface of the insert housing so as to be housed in a recess arranged on an opposite wall of the insert, when the insert is positioned in the insert housing.

7. A pole handle according to claim 1, wherein:

the latch is pin-shaped.

8. A pole handle according to claim 1, wherein:

the stop is a retaining pin cooperating with a cavity arranged in the latch.

9. A pole handle according to claim 1, wherein:

the insert housing has a tapered shape widening toward the upper opening; and walls of the insert cooperate with the insert housing, the walls being inclined and having a complementary general shape for guiding an engagement of the insert in the insert housing via positive connection.

10. A pole handle according to claim 1, wherein:

the insert comprises a transverse hinge shaft connecting the strap to the insert so as to enable the strap to rotate about an axis parallel to the direction when the insert is mounted in the body.

11. A pole handle according to claim 1, wherein:

the insert comprises a clearance in which the transverse hinge shaft is housed, the clearance having an upper opening out on an upper surface of the insert, and a rear opening extending along a rear transverse direction when the insert is retained in the body, the body comprising a rear clearance aligned with the rear opening when the insert is retained in the body to enable lateral pivoting of the strap between a vertical position and a horizontal position.

12. A pole handle according to claim 1, wherein:

an upper surface of the insert has an upper contour continuous with the upper end of the body when the insert is retained in the body.

13. A pole equipped with a handle according to claim 1.

14. A pole handle according to claim 1, wherein:

in an unlatched configuration of the latching mechanism, with the insert removed from the insert housing, the latch projects from an inner surface of the insert housing and faces an opposite inner surface of the insert housing, and the stop is positioned to block movement of the latch from engaging the opposite inner surface of the housing.

* * * * *